United States Patent [19]

Ellenberger

[11] 3,944,954

[45] Mar. 16, 1976

[54] EXCESS CURRENT SWITCHING DEVICE

[75] Inventor: Jakob Ellenberger, Altdorf near Nurnberg, Germany

[73] Assignee: Ellenberger & Poensgen GmbH, Altdorf near Nurnberg, Germany

[22] Filed: Nov. 19, 1974

[21] Appl. No.: 525,311

[30] Foreign Application Priority Data

Nov. 23, 1973 Germany ..... 2358382

[52] U.S. Cl. ..... 335/35; 335/38

[51] Int. Cl.[2] ..... H01H 75/12

[58] Field of Search ..... 335/35, 37, 38, 43

[56] References Cited

UNITED STATES PATENTS

| | | | |
|---|---|---|---|
| 2,831,935 | 4/1958 | Page | 335/43 X |
| 3,264,427 | 8/1966 | Hurtle | 335/35 |
| 3,324,429 | 6/1967 | Ellenberger | 335/35 |
| 3,706,057 | 12/1972 | Ellenberger | 335/43 X |

*Primary Examiner*—G. Harris

*Attorney, Agent, or Firm*—Spencer & Kaye

[57] ABSTRACT

An excess current switching device having particular but not exclusive application in switching direct current power.

The switching device comprises first and second excess current switches. The first switch comprises a break point and a thermal and/or electromagnetic tripping device(s) linked to a latching mechanism and the second switch comprises a break point and an electromagnetic tripping device having a high resistance coil linked to a latching mechanism. The break point of the first switch is connected in parallel with the tripping device of the second switch. When an excess current occurs, the break point of the first switch opens, leaving the tripping device of the second switch in curcuit and this opens the break point of the second switch.

7 Claims, 3 Drawing Figures

EXCESS CURRENT SWITCHING DEVICE

The invention relates to an excess current switching device having two interruption or break points which succeed one another and are sequentially opened upon the occurrence of an excess current.

An excess current switchingg device of this kind is known (German Pat. No. 1,058,616) which has an electromagnetic tripping device to release the armature which is of rod-shaped design. Both break points have contact bridges which co-operate with corresponding counter contact pieces. The counter contact pieces of one of the contact bridges are bridged by a resistor. This contact bridge is rigidly secured to one end of the rod-shaped armature. In the connected position of the two contact bridges the other end of the rod-shaped armature is situated at a specific spacing from the corresponding contact bridge so that upon electromagnetic tripping or release the contact bridge which is rigidly connected to the rod-shaped armature is first lifted off the counter contact pieces and thereby the resistor which is situated parallel to these contact pieces is connected into the circuit. This resistor reduces the excess current. Upon continued movement of the armature its other end encounters the second contact bridge so that the latter is lifted off its counter contact pieces and the circuit of the switching device is thereby interrupted. In the connected position of both contact bridges the contact pressure is produced by suitable springs. Since one of the contact bridges is rigidly connected to one of the ends of the rod-shaped armature the contact pressure of the contact bridge is reduced by the attraction of the armature as a result of the normal operating current. This reduction of the contact pressure is relatively great because the rod-shaped armature has to move both contact bridges into the disconnected position and therefore the electromagnet must be of large proportions. For this reason this known excess current switching device is not suitable for interrupting high power circuits.

The object of the present invention is to be able to interrupt high voltage circuits, particularly high direct voltages, e.g. 110, 144, 220, 360, 550 V, and to avoid the production of strong electric arcs.

According to the present invention there is provided an excess current switching device comprising a first excess current switch having a first break point and at least one tripping device effective to trip the first break point on the occurrence of an excess current and a second excess current switch having a second break point and an electromagnetic tripping device to trip the second break point on the occurrence of an excess current, the electromagnetic tripping device including a coil of high ohmic design, the electromagnetic tripping device being coupled in parallel with the first break point, whereby when the first break point is tripped, excess current flows through the electromagnetic tripping device to trip sequentially the second break point.

The tripping device of the first excess current switch may comprise a thermal tripping device, an electromagnetic tripping device or a combination of both.

In an embodiment of the present invention, when an excess current occurs, the first excess current switch first releases or trips thermally and/or electromagnetically so that the break point of the first excess current switch is opened. The excess current is very much reduced by the high-ohmic magnet coil of the second excess current switch. There is no interruption of the excess current since the high-ohmic field coil of the second excess current switch is situated parallel to the opened break point of the first excess current switch. The current flowing through this magnet coil now causes tripping of the second excess current switch so that its break point is opened and thus the current circuit of the excess current switching device is interrupted. By having this two stage arrangement, the contact pieces of the break points of the two excess current switches are conserved so that the excess current switching device made in accordance with the present invention has a long useful life. The excess current switching device according to the invention enables high currents to be switched off at high direct voltages, e.g. 110, 144, 220, 360, 500 V. Apart from the switching-off efficiency at high direct voltages, the excess current switching device in accordance with the present invention has the additional advantage of the voltage peaks, which form when inductive loads are switched off, being suppressed thereby reducing or eliminating arcing.

An optimum adaptation of the magnet coil of the second excess current switch to that of the first excess current switch is obtained when outputs in a ratio of 3:1 are switched off by both excess current switches at their break points. This means that the first excess current switch is capable of disconnecting three times the power output of the second excess current switch.

Preferably, the two excess current switches, which have flat elongated shapes, are arranged adjacent each other with their broad sides contacting and a rocker is pivotably mounted between adjacent ON keys and adjacent OFF keys of the switches whereby the two ON keys or the two OFF keys are selectively actuatable together. Thus both excess current switches can be switched on or off by means of the rocker.

An embodiment of the present invention will now be described, by way of example, with reference to the accompanying drawings, wherein.

Figure 1:
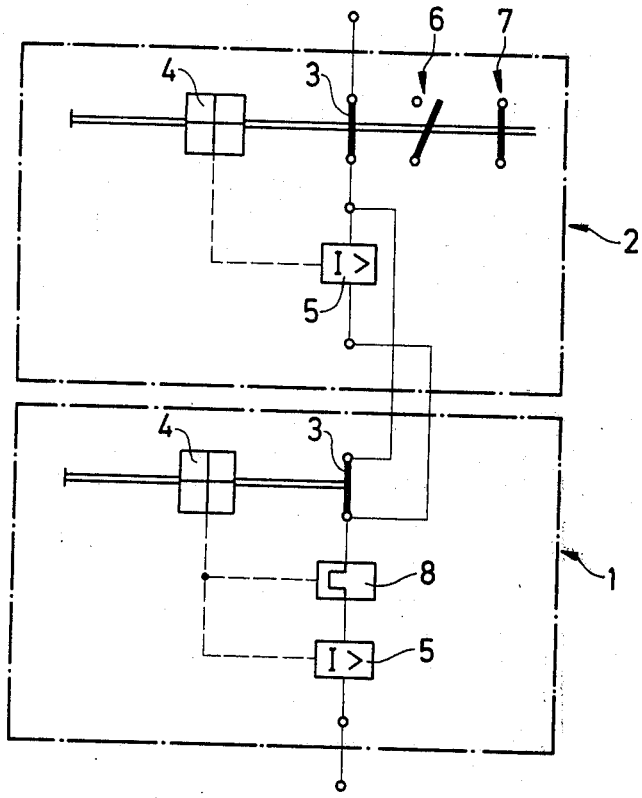
FIG. 1 shows a circuit of an excess current switching device made in accordance with the invention.

The excess current switching device comprises first and second excess current switches 1, 2, as schematically illustrated in FIG. 1. Both excess current switches 1, 2 have a break point 3, a latching cam 4 and an electro-magnetic tripping devide 5 linked to the latching cam 4. The tripping device of the switch 2 has a high resistance magnet coil. A thermal tripping device 8 is provided in the excess current switch and is linked to the latching cam 4. If desired, one or other of the tripping devices 5, 8, may be omitted. The excess current switch 2 may additionally be provided with signal contacts 6, 7 of which the signal contact 6 is a circuit opener and the signal contact 7 is a circuit closer. The signal contacts serve to indicate the switching positions of the excess current switch 2 and thus to indicate the switching positions of the entire excess current switching device.

As shown in the drawing the excess current switching device is connected in series into a circuit to be monitored by means of terminals connected to the electromagnetic tripping device 5 of the excess current switch 1 and to the break point 3 of the excess current switch 2. The excess current switches 1, 2 are connected so that the electromagnetic tripping device 5 of the excess current switch 2 is in parallel with the break point 3 of the excess current switch 1. In the condition shown, the primary current flow is through the series connected tripping devices 5 and 8 and the break point 3 of the excess current switch 1 and through the break point 3 of the excess current switch 2. If the excess current switch 1 is tripped, the current flow is via the high resistance magnet coil of the tripping device 5 of the excess current switch 2. When the excess current switch 2 is tripped, the circuit through the device is completely interrupted.

The excess current switch 1 is designed to be able to disconnect three times the rated power output of the excess current switch 2.

The excess current switching device of FIG. 1 works in the following manner:

When an excess current occurs, then the excess current switch 1 first trips either thermally or electromagnetically so that the break point 3 is opened via the latching cam 4. The electromagnetic tripping device 5 of the excess current switch 2 is thereby in series with the electromagnetic tripping device 5 and the thermal tripping device 8 of the excess current switch 1. The field coil of the electromagnetic tripping device 5 of the excess current switch 2 is of high-ohmic design and thereby reduces the excess current such that the electromagnetic tripping device 5 of the excess current switch 2 is triggered by this reduced excess current and the break point 3 of the excess current switch 2 is opened via the latching cam 4. The entire circuit of the excess current switching device of FIG. 1 is thereby interrupted. The opening travel of the movable switching element of the break point 3 of the excess current switch 2 is sufficiently large to extinguish an appearing electric arc. Although the current in the excess current switching device is not interrupted when the break point 3 of the excess current switch 1 is opened, an electric arc, which however is not harmful, appears at the opened break point 3 of the excess current switch 1 as a result of the large voltage drop at the highly resistive magnet coil of the electromagnetic tripping device 5 of the excess current switch 2. By virtue of the two break points 3 of the two excess current switches 1 and 2 the total potential is divided into two partial potentials. The electromagnetic tripping device 5 of the excess current switch 2 responds directly after opening of the break point 3 of the excess current switch 1.

Figure 2:
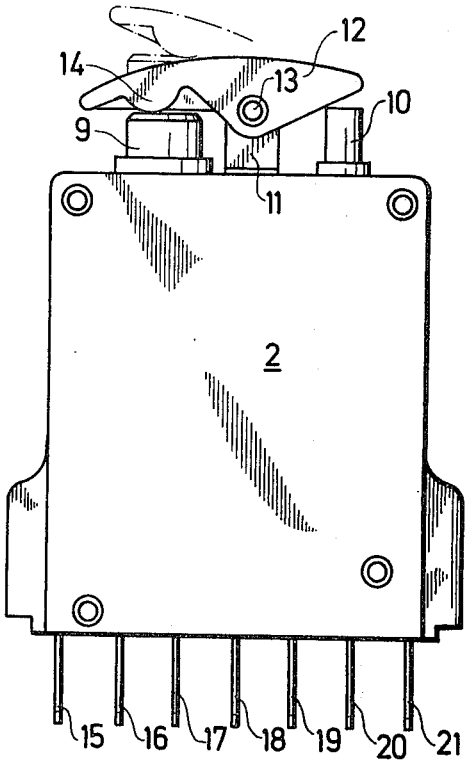
FIG. 2 shows a frontal view of the excess current switching device of FIG. 1.
Figure 3:
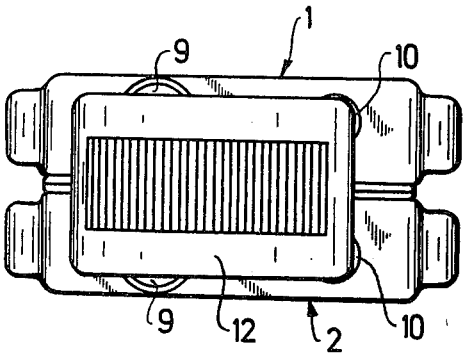
FIG. 3 shows a plan view to FIG. 2.

As is particularly apparent from FIG. 3 both excess current switches 1 and 2 are of narrow elongate form and contact one another with their broad sides. Both excess current switches 1 and 2 are provided with an ON push button 9 and an OFF push button 10. FIGS. 2 and 3 show that the ON push buttons 9 and the OFF push buttons 10 are located side by side. Between the ON push buttons 9 and the OFF push buttons 10 a bearing block 11 is secured to the upper side of the two excess current switches 1 and 2 on which bearing block a rocker 12 is pivotably mounted by means of a pin 13. When the rocker 12 is pivoted in anti-clockwise direction the two ON keys 9 are urged, by means of a projection 14 of the rocker 12, into the housing and the two excess current switches 1 and 2 are thereby switched on. This switched-on position is shown in FIG. 2 by full lines. The actuation of the OFF keys 10 and thus switching-off of the excess current switches 1 and 2 results from pivoting the rocker 12 in clockwise direction. The corresponding position of the rocker 12 is illustrated in FIG. 2 by dot-dash lines.

The excess current switch 2 has terminals 15 to 21 of which the terminals 15, 18 are associated with the break point 3, the terminals 18, 21 with the electromagnetic tripping device 5, the terminals 16, 20 with one of the two signal contacts 6, 7 and the terminals 17, 19 with the other signal contact. The excess current switch 1 on the other hand has only terminals 15, 18, 21. In the series connection of the electromagnetic tripping device 5 and the thermal tripping device 8 shown in FIG. 1 all the terminals 15, 18, 21 are used.

When two excess current switches 1 and 2 are combined without a common rocker 12, then after tripping of the excess current switching device, the excess current switch 1 must be first switched on and only then should the excess current switch 2 be actuated, as otherwise, when there is an excess current which does not yet result in magnetic tripping, there will be a risk of the magnet coil of the tripping device 5 of the excess current switch 2 being destroyed.

We claim:

1. An excess current switching device comprising, in combination:
   a. a first excess current switch having
      i. a first break point, and
      ii. at least one tripping device effective to trip said first break point on the occurrence of an excess current,
   b. a second excess current switch having
      i. a second break point, and
      ii. an electromagnetic tripping device effective to trip said second break point on the occurrence of an excess current, said electromagnetic tripping device having a coil of high ohmic design, said electromagnetic tripping device being coupled in parallel with said first break point, whereby when said first break point is tripped, excess current flows through said electromagnetic tripping device to trip sequentially said second break point.

2. An excess current switching device, as claimed in claim 1, wherein said at least one tripping device comprises a thermal tripping device.

3. An excess current switching device, as claimed in claim 2, further comprising an electromagnetic tripping device coupled in series with said thermal tripping device.

4. An excess current switching device, as claimed in claim 1, wherein said at least one tripping device comprises another electromagnetic tripping device.

5. An excess current switching device as claimed in claim 1, wherein said first and second excess current switches are arranged to switch outputs in the ratio 3:1 at their respective break points.

6. An excess current switching device as claimed in claim 1, wherein each said first and second excess current switch further comprises an ON push button and an OFF push button spaced therefrom.

7. An excess current switching device as claimed in claim 6, wherein said first and second excess current switches are of elongate cross section and are arranged side by side and with their ON push buttons adjacent each other and their OFF push buttons adjacent each other, and further comprising a rocker pivotally mounted between the adjacent ON and OFF push buttons for selectively actuating one of the two ON push buttons and the two OFF push buttons.

* * * * *